US009482135B2

(12) United States Patent
Lorenz et al.

(10) Patent No.: US 9,482,135 B2
(45) Date of Patent: Nov. 1, 2016

(54) DUAL FUEL DIESEL OXIDATION CATALYST WITH REMOVABLE CATALYSTS

(71) Applicant: Cummins Emission Solutions, Inc., Columbus, IN (US)

(72) Inventors: Tyler Lorenz, McFarland, WI (US); Vipin Iyer, Madison, WI (US); Ken Hummel, Barneveld, WI (US); Rahul Kallurwar, Columbus, IN (US); Justin Kruer, Franklin, IN (US); James Klingbeil, Edgerton, WI (US)

(73) Assignee: CUMMINS EMISSION SOLUTIONS, INC., Columbus, IN (US)

( * ) Notice: Subject to any disclaimer, the term of this patent is extended or adjusted under 35 U.S.C. 154(b) by 131 days.

(21) Appl. No.: 14/456,438

(22) Filed: Aug. 11, 2014

(65) Prior Publication Data

US 2016/0040578 A1 Feb. 11, 2016

(51) Int. Cl.
*F01N 3/10* (2006.01)
*F01N 3/28* (2006.01)

(52) U.S. Cl.
CPC ..... *F01N 3/2878* (2013.01); *F01N 3/103* (2013.01); *F01N 3/2853* (2013.01)

(58) Field of Classification Search
CPC ..... F01N 13/0097; F01N 13/1855; F01N 13/009; F01N 3/035; F01N 2450/30; F01N 2450/02; F01N 2450/24; F01N 3/28; C01B 2203/1241
USPC ..... 60/299, 297, 301; 29/890
See application file for complete search history.

(56) References Cited

U.S. PATENT DOCUMENTS 4,250,146 A * 2/1981 Bailey ..... F01N 3/2875 422/179
4,843,815 A * 7/1989 Smojver ..... B01D 53/9454 422/179
6,415,603 B1 * 7/2002 Nowka ..... F01N 3/2882 285/223
7,157,060 B1 * 1/2007 Newburry ..... B01D 53/9454 422/168
8,062,602 B2 11/2011 Roe et al.
8,276,366 B2 10/2012 Bennet et al.
2006/0159597 A1 * 7/2006 Muter ..... F01N 3/2839 422/168
2008/0229733 A1 * 9/2008 Newburry ..... F01N 3/2839 60/299
2009/0025376 A1 * 1/2009 Ahmed ..... B01D 53/8631 60/299
2010/0129270 A1 * 5/2010 Roe ..... F01N 3/2839 422/171
2010/0186394 A1 7/2010 Harrison et al.
2013/0287635 A1 * 10/2013 Muter ..... F01N 3/2875 422/129
2015/0157981 A1 * 6/2015 Isada ..... F16M 13/02 422/171

* cited by examiner

*Primary Examiner* — Patrick Maines
(74) *Attorney, Agent, or Firm* — Foley & Lardner LLP

(57) ABSTRACT

A diesel oxidation catalyst component may include an inlet, an outlet, and a catalyst chamber body in fluid communication with the inlet and the outlet. An angled jacking bolt assembly is configured to secure a diesel oxidation catalyst within a catalyst chamber defined by the catalyst chamber body. In some implementations, a spacing component or a second diesel oxidation catalyst may be included and secured by the angled jacking bolt assembly. The catalyst chamber body may include an access panel assembly that includes an access panel and securing bolts. The access panel assembly may substantially fluidly seal an opening defined by a mount of the catalyst chamber body when the access panel is secured to the mount by the plurality of securing bolts. The opening may be sized to permit removal of the diesel oxidation catalyst from within the catalyst chamber.

20 Claims, 4 Drawing Sheets

DUAL FUEL DIESEL OXIDATION CATALYST WITH REMOVABLE CATALYSTS

TECHNICAL FIELD

The present application relates generally to the field of aftertreatment systems for internal combustion engines. More specifically, the present application relates to diesel oxidation catalyst systems.

BACKGROUND

For internal combustion engines, such as diesel engines, nitrogen oxides ($NO_x$) compounds may be emitted in the exhaust. To reduce $NO_x$ emissions, a selective catalytic reduction (SCR) process may be implemented to convert the $NO_x$ compounds into more neutral compounds, such as diatomic nitrogen, water, or carbon dioxide, with the aid of a catalyst and a reductant. The catalyst may be included in a catalyst chamber of an exhaust system, such as that of a vehicle or power generation unit. A reductant, such as anhydrous ammonia, aqueous ammonia, or urea, is typically introduced into the exhaust gas flow prior to the catalyst chamber. To introduce the reductant into the exhaust gas flow for the SCR process, an SCR system may dose or otherwise introduce the reductant through a dosing module that vaporizes or sprays the reductant into an exhaust pipe of the exhaust system up-stream of the catalyst chamber. In some instances, a diesel oxidation catalyst (DOC) component may be included in the exhaust train or exhaust system to oxidize hydrocarbons and/or carbon monoxide in the exhaust gas. A DOC component may contain catalysts to oxidize hydrocarbons and carbon monoxide into carbon dioxide and water

SUMMARY

One implementation relates to a diesel oxidation catalyst component including an inlet, an outlet, and a catalyst chamber coy in fluid communication with the inlet and the outlet. The catalyst chamber body includes an angled jacking bolt assembly configured to secure a diesel oxidation catalyst within a catalyst chamber defined by the catalyst chamber body. In some implementations, the angled jacking bolt assembly includes several angled threaded mounts and several jacking bolts. Each of the jacking bolts may be configured to thread through a respective angled threaded mount so as to secure the diesel oxidation catalyst within the catalyst chamber. In some implementations, the catalyst chamber body includes an inner ring and the angled jacking bolt assembly is configured to apply a lateral compression force to the diesel oxidation catalyst against the inner ring. A bolt of the angled jacking bolt assembly may engage a spacing component to apply the lateral compression force to the diesel oxidation catalyst. In some instances, the diesel oxidation catalyst is a second diesel oxidation catalyst, and a bolt of the angled jacking bolt assembly engages a first diesel oxidation catalyst to apply the lateral compression force to the second diesel oxidation catalyst. In some implementations, a sealing gasket is interposed between the diesel oxidation catalyst and the inner ring. In further implementations, the catalyst chamber body includes an access panel assembly that includes an access panel and several securing bolts. The access panel assembly may substantially fluidly seal an opening defined by a mount of the catalyst chamber body when the access panel is secured to the mount by the securing bolts. The opening may be sized to permit removal of the diesel oxidation catalyst from within the catalyst chamber of the catalyst chamber body. In some instances, the diesel oxidation catalyst is removable from within the catalyst chamber of the catalyst chamber body without removing the diesel oxidation catalyst component from an exhaust system.

Another implementation relates to a system including an internal combustion engine and a diesel oxidation catalyst. The diesel oxidation catalyst includes an outlet, a first inlet in fluid communication with a first exhaust manifold of the internal combustion engine, a second inlet in fluid communication with a second exhaust manifold of the internal combustion engine, and a catalyst chamber body in fluid communication with the first inlet and the second inlet. The catalyst chamber body may include a first diesel oxidation catalyst assembly and a second diesel oxidation catalyst assembly. The first diesel oxidation catalyst assembly may be positioned in a first exhaust flow path from the first inlet to the outlet and may include a first angled jacking bolt assembly configured to secure a first diesel oxidation catalyst within a catalyst chamber defined by the catalyst chamber body. The second diesel oxidation catalyst assembly may be positioned in a second exhaust flow path from the second inlet to the outlet and may include a second angled jacking bolt assembly configured to secure a second diesel oxidation catalyst within a catalyst chamber defined by the catalyst chamber body. In some implementations, the first angled jacking bolt assembly includes several angled threaded mounts and several jacking bolts. Each of the jacking bolts may be configured to thread through a respective angled threaded mount so as to secure the first diesel oxidation catalyst within the catalyst chamber. The catalyst chamber body may further include an inner ring, and the first angled jacking bolt assembly may be configured to apply a lateral compression force to the first diesel oxidation catalyst against the inner ring. In some instances, a bolt of the first angled jacking bolt assembly may engage a spacing component to apply the lateral compression force to the first diesel oxidation catalyst. In other instances, a bolt of the first angled jacking bolt assembly may engage a third diesel oxidation catalyst to apply the lateral compression force to the first diesel oxidation catalyst. In some implementations, a sealing gasket is interposed between the first diesel oxidation catalyst and the inner ring. The catalyst chamber body may further include an access panel assembly having an access panel and securing bolts. The access panel assembly may substantially fluidly seal an opening defined by a mount of the catalyst chamber body when the access panel is secured to the mount by the securing bolts.

Yet another implementation relates to a catalyst chamber body including an angled jacking bolt assembly and an access panel assembly. The angled jacking bolt assembly may include several angled threaded mounts and several jacking bolts. Each of the jacking bolts may be configured to thread through a respective angled threaded mount so as to secure a diesel oxidation catalyst within a catalyst chamber. The access panel assembly may include an access panel and several securing bolts. The access panel assembly may substantially fluidly seal an opening defined by a mount of the catalyst chamber body when the access panel is secured to the mount by the securing bolts. In some implementations, the catalyst chamber body may further include an inner ring and each of the jacking bolts may be configured to apply a lateral compression force to the diesel oxidation catalyst against the inner ring when threaded through a respective angled threaded mount. In some instances, the opening is sized to permit removal of the diesel oxidation catalyst from within the catalyst chamber.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
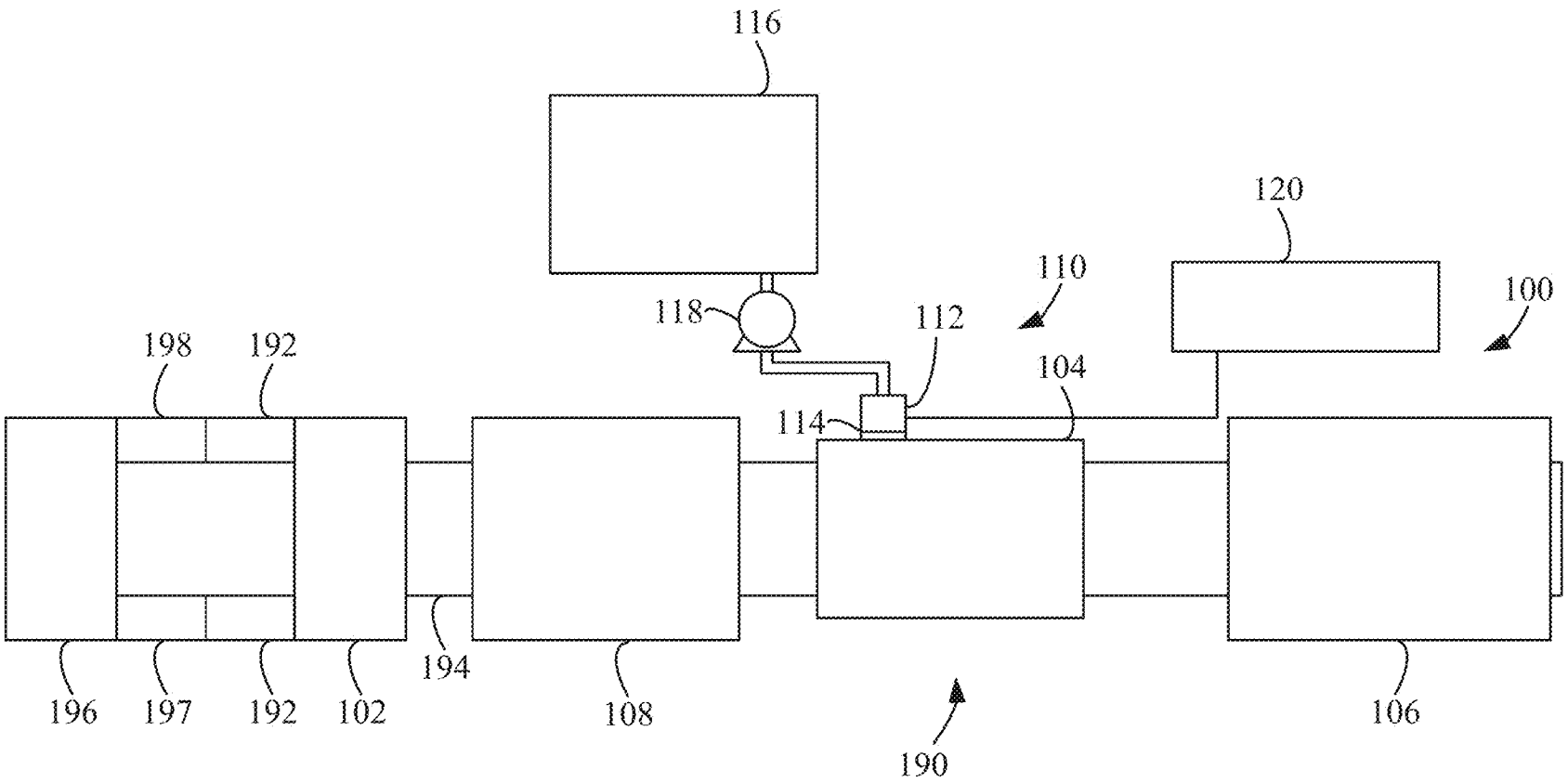
FIG. 1 is a block schematic diagram of a selective catalytic reduction system having a reductant delivery system for an exhaust system.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for diesel oxidation catalysts for an exhaust system of a vehicle. The various concepts introduced above and discussed in greater detail below may be implemented in any of numerous ways, as the described concepts are not limited to any particular manner of implementation. Examples of specific implementations and applications are provided primarily for illustrative purposes.

I. Overview

In exhaust systems, a diesel oxidation catalyst (DOC) component may be provided to oxidize hydrocarbons and carbon monoxide in the exhaust gas. The DOC component may be upstream or downstream of an SCR catalyst. The DOC component includes one or more diesel oxidation catalysts located within a catalyst chamber of the DOC component. Such catalysts may degrade overtime and/or need to be replaced or serviced. In some instances, this may require removal and replacement of the entire DOC component, requiring the DOC component to be disconnected from the entire exhaust system. In some instances, DOC components may provide a removable portion to access and/or remove the diesel oxidation catalysts inside the catalyst chamber of the DOC component. Some systems include linear compressive bolting arrangements to secure the removable/serviceable diesel oxidation catalysts within the catalyst chamber of the DOC component. Such linear compressive bolting arrangements may require jam nuts to be secured. In addition, such systems may reduce the uniform flow of exhaust gas across the diesel oxidation catalyst, thereby reducing the effectiveness of the diesel oxidation catalyst in oxidizing hydrocarbons and/or carbon monoxide in the exhaust gas. Furthermore, such systems may need larger outer diameters to accommodate the linear compressive bolting arrangement, thereby increasing the profile of the DOC component.

As described in greater detail herein, a DOC component may include angled jacking bolts to engage with a surface of a diesel oxidation catalyst and/or spacing component to secure the diesel oxidation catalyst(s) and/or spacing component within the catalyst chamber of the DOC component. The diesel oxidation catalyst(s) may be compressed against a downstream sealing gasket abutting an inner rim of the catalyst chamber by the angled jacking bolts. The angled jacking bolts may be thread into standoffs on an outer surface of the DOC component. As the angled jacking bolts are tightened, each angled jacking bolt applies an axial force vector component to the spacing component and/or diesel oxidation catalyst. Such angled jacking bolts may not need jam nuts, may substantially maintain the uniform flow of exhaust gas across the diesel oxidation catalyst by minimally intruding into the catalyst chamber, and may minimally increase the size of outer portions of the DOC component, thereby substantially maintaining the profile of the DOC component while providing removability/serviceability for the diesel oxidation catalysts in the DOC component.

Moreover, the DOC component may be reconfigurable using spacing components to permit different configurations for the diesel oxidation catalysts of the DOC component. For instance, a user of a vehicle may not have access to high grade fuel (e.g., access to Methane Number 50 (MN50) compressed natural gas versus Methane Number 100 (MN100) compressed natural gas), which may result in higher concentrations of unconsumed hydrocarbons or carbon monoxide in the exhaust gas. For such vehicles, the DOC component may be configured to include four diesel oxidation catalysts to oxidize the unconsumed hydrocarbons or carbon monoxide in the exhaust gas. For users of the vehicle that have access to high grade fuel, which may result in lower concentrations of unconsumed hydrocarbons or carbon monoxide in the exhaust gas, the DOC component may be reconfigured with fewer diesel oxidation catalysts, such as two diesel oxidation catalysts. Thus, the modifiable DOC component may be useful for both reconfiguring the DOC component with varying diesel oxidation catalysts and for removability/serviceability for the diesel oxidation catalysts in the DOC component.

II. Overview of Aftertreatment System

FIG. 1 depicts an aftertreatment system 100 having an example reductant delivery system 110 for an exhaust system 190. The aftertreatment system 100 includes a diesel oxidation catalyst (DOC) component 102, a diesel particulate filter (DPF) 108, the reductant delivery system 110, a decomposition chamber or reactor 104, and a SCR catalyst 106.

The DOC component 102 is in fluid communication with the exhaust system 190 (e.g., upstream of the DPF 108 or downstream of the SCR catalyst 106) to oxidize hydrocarbons and carbon monoxide in the exhaust gas. In the present example, the DOC component 102 is in fluid communication with two inlets 192 of the exhaust system and has a single outlet 194 leading to the rest of the exhaust system 190 and aftertreatment components. Each inlet 192 may receive exhaust gas from a respective exhaust manifold 197, 198 that receives and aggregates exhaust gas from several combustion chambers of the engine 196. For instance, each inlet 192 may be coupled to an exhaust manifold 197, 198 that corresponds to a set of combustion chambers on a corresponding side of an internal combustion engine 196 (e.g., for a V-shaped engine 196, a left manifold 197 may receive and aggregate exhaust gases from the set of combustion chambers on the left side of the V shape). In some implementations, one or more turbochargers may be included between each inlet 192 and the respective exhaust manifold 197, 198.

The DOC component 102 includes one or more diesel oxidation catalysts within a catalyst chamber of the DOC component 102. As will be described in greater detail below, the DOC component 102 may include a diesel oxidation catalyst or set of catalysts for each of the two inlets 192. The exhaust gas from a first inlet 192 passes through a respective diesel exhaust catalyst or set of catalysts on a respective side of the DOC component 102 and combines with the exhaust gas from the second inlet 192 that passes through a respective diesel exhaust catalyst or set of catalysts on a respective side of the DOC component 102 at a central portion of the catalyst chamber of the DOC component 102 to flow out the outlet 194.

The DPF 108 is configured to remove particulate matter, such as soot, from exhaust gas flowing in the exhaust system 190. The DPF 108 includes an inlet, where the exhaust gas is received from the DOC component 102, and an outlet, where the exhaust gas exits after having particulate matter substantially filtered from the exhaust gas and/or converting the particulate matter into carbon dioxide. In some implementations, the DPF 108 may be upstream of the DOC component 102 or may be omitted.

The decomposition chamber 104 is configured to convert a reductant, such as urea, aqueous ammonia, or diesel exhaust fluid (DEF), into ammonia. The decomposition chamber 104 includes a reductant delivery system 110 having a dosing module 112 configured to dose the reductant into the decomposition chamber 104. In some implementations, the urea, aqueous ammonia, or DEF is injected upstream of the SCR catalyst 106. The reductant droplets then undergo the processes of evaporation, thermolysis, and hydrolysis to form gaseous ammonia within the exhaust system 190. The decomposition chamber 104 includes an inlet in fluid communication with the DPF 102 to receive the exhaust gas containing $NO_x$ emissions and an outlet for the exhaust gas, NO emissions, ammonia, and/or remaining reductant to flow to the SCR catalyst 106.

The decomposition chamber 104 includes the dosing module 112 mounted to the decomposition chamber 104 such that the dosing module 112 may dose a reductant, such as urea, aqueous ammonia, or DEF, into the exhaust gases flowing in the exhaust system 190. The dosing module 112 may include an insulator 114 interposed between a portion of the dosing module 112 and the portion of the decomposition chamber 104 to which the dosing module 112 is mounted. The dosing module 112 is fluidly coupled to one or more reductant sources 116. In some implementations, a pump 118 may be used to pressurize the reductant from the reductant source 116 for delivery to the dosing module 112. In some implementations, the dosing module 112 may be positioned upstream of the DOC component 102 and/or DPF 108.

The dosing module 112 is also electrically or communicatively coupled to a controller 120. The controller 120 is configured to control the dosing module 112 to dose reductant into the decomposition chamber 104. The controller 120 may include a microprocessor, an application-specific integrated circuit (ASIC), a field-programmable gate array (FPGA), etc., or combinations thereof. The controller 120 may include memory which may include, but is not limited to, electronic, optical, magnetic, or any other storage or transmission device capable of providing a processor, ASIC, FPGA, etc. with program instructions. The memory may include a memory chip, Electrically Erasable Programmable Read-Only Memory (EEPROM), erasable programmable read only memory (EPROM), flash memory, or any other suitable memory from which the controller 120 can read instructions. The instructions may include code from any suitable programming language.

The SCR catalyst 106 is configured to assist in the reduction of NO emissions by accelerating a $NO_x$ reduction process between the ammonia and the NO of the exhaust gas into diatomic nitrogen, water, and/or carbon dioxide. The SCR catalyst 106 includes inlet in fluid communication with the decomposition chamber 104 from which exhaust gas and reductant is received and an outlet in fluid communication with an end of the exhaust system 190.

III. Example Diesel Oxidation Catalyst Component

Figure 2:
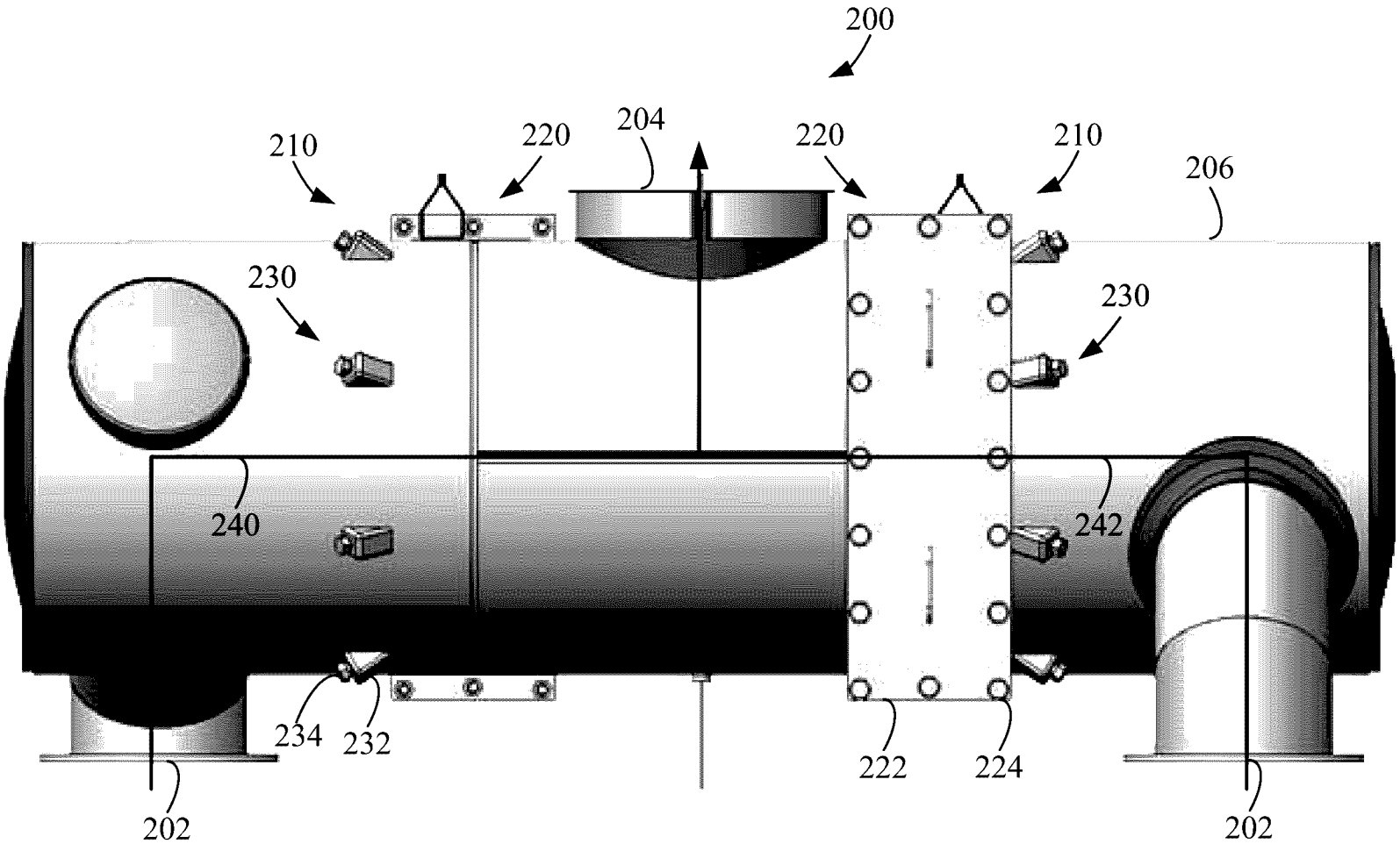
FIG. 2 is a side elevation view of an implementation of a diesel oxidation catalyst component having a catalyst chamber body, two inlets, an outlet, and diesel oxidation catalyst assemblies for each inlet.

FIG. 2 depicts a side elevation view of an example DOC component 200 having a catalyst chamber body 206, two inlets 202, an outlet 204, and diesel oxidation catalyst assemblies 210 for each inlet 202. Each inlet 202 receives exhaust gas from a respective exhaust manifold (not shown) that receives and aggregates exhaust gas from several combustion chambers of an engine. For instance, each inlet 202 may be coupled to an exhaust manifold that corresponds to a set of combustion chambers on a corresponding side of an internal combustion engine (e.g., for a V-shaped engine, a left manifold may receive and aggregate exhaust gases from the set of combustion chambers on the left side of the V shape and a right manifold may receive and aggregate exhaust gases from the set of combustion chambers on the right side of the V shape). In some implementations, one or more turbo components may be interposed between the inlets 202 and the exhaust manifold.

The DOC component 200 receives the exhaust gas from the inlets 202 into a catalyst chamber defined by the catalyst chamber body 206. One or more diesel oxidation catalysts can be disposed within the catalyst chamber of the catalyst chamber body 206 between the inlets 202 and the outlet 204 such that the exhaust gas flows through the one or more diesel oxidation catalysts when traveling from the inlets 202 to the outlet 204. For instance, a first diesel oxidation catalyst of a first diesel oxidation catalyst assembly 210 may be positioned in between a first exhaust flow path 240 from a first inlet 202 to the outlet 204. A second diesel oxidation catalyst of a second diesel oxidation catalyst assembly 210 may be positioned in between a second exhaust flow path 242 from a second inlet 202 to the outlet 204. In some implementations, the catalyst chamber body 206 may be a cylindrical hollow body.

The catalyst chamber body 206 includes diesel oxidation catalyst assemblies 210 disposed between each inlet 202 and the outlet 204. Each diesel oxidation catalyst assembly 210 includes an access panel assembly 220, an angled jacking bolt assembly 230, and one or more diesel oxidation catalysts and/or spacing components secured within a catalyst chamber of the DOC component 200 by the angled jacking bolt assembly 230. The diesel oxidation catalysts can be removed and replaced and/or serviced to meet certain emission or useful life requirements. The diesel oxidation catalysts are secured in place by an angled bolted joint connection that serves to secure and seal the diesel oxidation catalysts in position. In some implementations, the diesel oxidation catalyst assemblies 210 may each house a diesel oxidation catalyst and a spacing component or may house several diesel oxidation catalysts, such as two diesel oxidation catalysts. Thus, the two diesel oxidation catalyst assemblies 210 of the DOC component 200 can, in combination, house two catalysts, four catalysts, or more than four catalysts. For instance, a user may opt to install two diesel oxidation catalysts and utilize two spacing components (e.g., if the exhaust gas from the engine has lower concentrations of hydrocarbons and/or carbon monoxide to oxidize, such as when using 100 Methane number natural gas) or may choose to eliminate the spacer components and install 4 catalysts for altered emissions requirements (dependent upon natural gas or dual fuel quality). The diesel oxidation catalyst assemblies 210 features a serviceable catalyst design such that the diesel oxidation catalysts may be removed and replaced at predetermined service intervals, depending on the configuration selected.

The access panel assembly 220 includes an access panel 222 and a plurality of securing bolts 224 for coupling the access panel 222 to a mount of the catalyst chamber body 206 of the DOC component 200. In some implementations, a gasket may be interposed between a bottom surface of the access panel 222 and the mount of the catalyst chamber body 206 of the DOC component 200 to assist in fluidly sealing the access panel 222 and the mount. The mount of the catalyst chamber body 206 of the DOC component 200 includes an opening (shown in FIG. 5) through which access is provided to the diesel oxidation catalyst(s) and/or spacing component within the DOC component 200. The opening is sized to permit removal of the diesel oxidation catalyst and/or spacing component from within the catalyst chamber of the catalyst chamber body 206. Thus, the diesel oxidation catalysts and/or spacing components within the DOC component 200 may be removed, replaced, serviced, etc. without removing the DOC component 200 from an exhaust system. In some implementations, the diesel oxidation catalysts may be removed and replaced halfway through the life of the aftertreatment system. The access panel 222 may be secured by sixteen bolts 224. The access panel 222 may alternatively be secured by more than sixteen bolts 224 or less than sixteen bolts 224. In some implementations, the access panels 222 include one or more grab handles and can be completely removed in order to service the diesel oxidation catalyst(s) and/or spacing components. The access panel assembly 220 can substantially fluidly seal the opening when the access panel 222 is secured to the mount by the plurality of securing bolts 224.

The catalyst chamber body 206 includes an angled jacking bolt assembly 230 that comprises a plurality of angled threaded mounts 232 configured to receive bolts 234 such that an end of each bolt 234 extends into the catalyst chamber defined by the catalyst chamber body 206 of the DOC component 200 to engage with a diesel oxidation catalyst and/or spacing component. The angled threaded mounts 232 are radially spaced about a circumference of the catalyst chamber body 206. In some implementations, the angled threaded mounts 232 are equally spaced about the circumference of the catalyst chamber body 206 and welded thereto. In some instances, eight angled threaded mounts 232 may be equally spaced about the circumference of the catalyst chamber body 206. When a bolt 234 is threaded through the angled threaded mount 232 such that an end of the bolt 234 extends into the catalyst chamber to engage with a diesel oxidation catalyst and/or spacing component, the bolt 234 may compress against one or more diesel oxidation catalysts and/or spacing components to compress the one or more diesel oxidation catalysts and/or spacing component against a downstream sealing gasket, as will be described in greater detail in reference to FIGS. 3-4.

Figure 3:
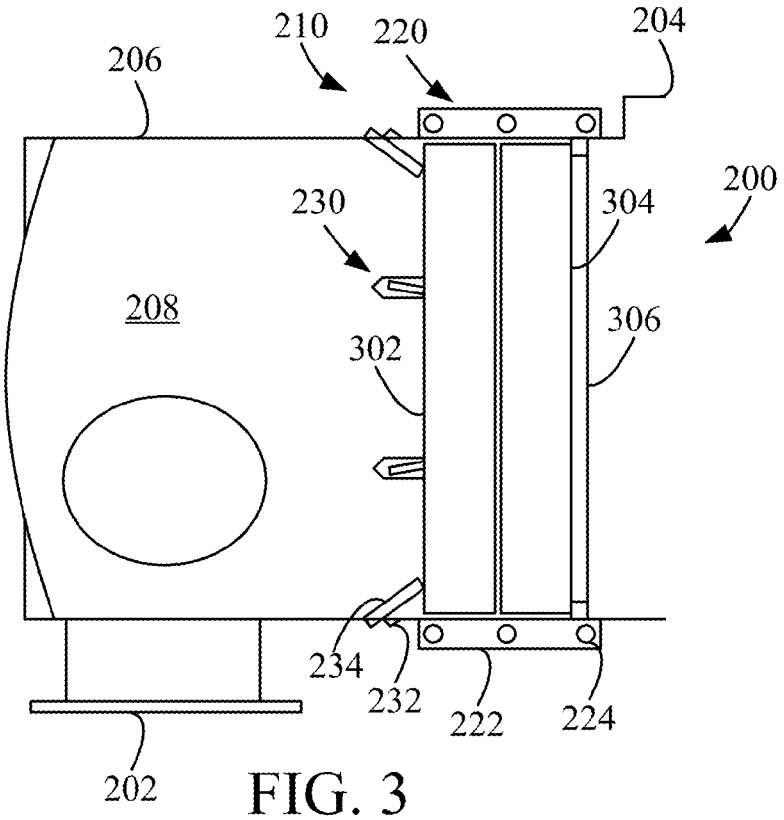
FIG. 3 is a partial cross-sectional view of the diesel oxidation catalyst component of FIG. 2 in a first configuration showing a spacing component and a diesel oxidation catalyst secured between bolts of an angled jacking bolt assembly and an inner ring of the catalyst chamber body of the diesel oxidation catalyst component.

FIG. 3 depicts a partial cross-sectional view of the DOC component 200 of FIG. 2 showing a spacing component 302 and a diesel oxidation catalyst 304 secured between bolts 234 of the angled jacking bolt assembly 230 and an inner ring 306 of the catalyst chamber body 206 of the DOC component 200. FIG. 3 depicts a first configuration for the diesel oxidation catalyst assembly 210 having a single diesel oxidation catalyst 304 and a spacing component 302. Each bolt 234 is guided by and attached to the angled threaded mounts 232 such that an end of each bolt 234 contacts and engages with the spacing component 302 to provide a lateral compression force against the spacing component 302 when each bolt 234 is threaded into the angled threaded mounts 232. The spacing component 302 abuts a diesel oxidation catalyst 304 such that the compression force applied to the spacing component 302 is transferred and applied to the diesel oxidation catalyst 304. In some implementations, a gasket or other intermediary component may be interposed between the spacing component 302 and the diesel oxidation catalyst 304. The diesel oxidation catalyst 304 is compressed against an inner ring 306 of the catalyst chamber 208 of the DOC component 200 such that the bolts 234 and the inner ring 306 of the catalyst chamber body 206 cooperate to secure the spacing member 302 and the diesel oxidation catalyst 304 within the catalyst chamber 208. In some implementations, a sealing gasket may be interposed between the diesel oxidation catalyst 304 and the inner ring 306 of the catalyst chamber body 206 of the DOC component 200.

Once the bolts 234 are tightened to a specified torque, the spacing component 302 and the diesel oxidation catalyst 304 are no longer free to move about within the catalyst chamber 208 of the DOC component 200. In the event that an aftertreatment system requires four diesel oxidation catalysts (e.g., for systems using fuel that produces a higher concentration of hydrocarbons) instead of two diesel oxidation catalysts, the bolts 234 may be loosened and the spacing component 302 may be replaced with an additional diesel oxidation catalyst.

Figure 4:
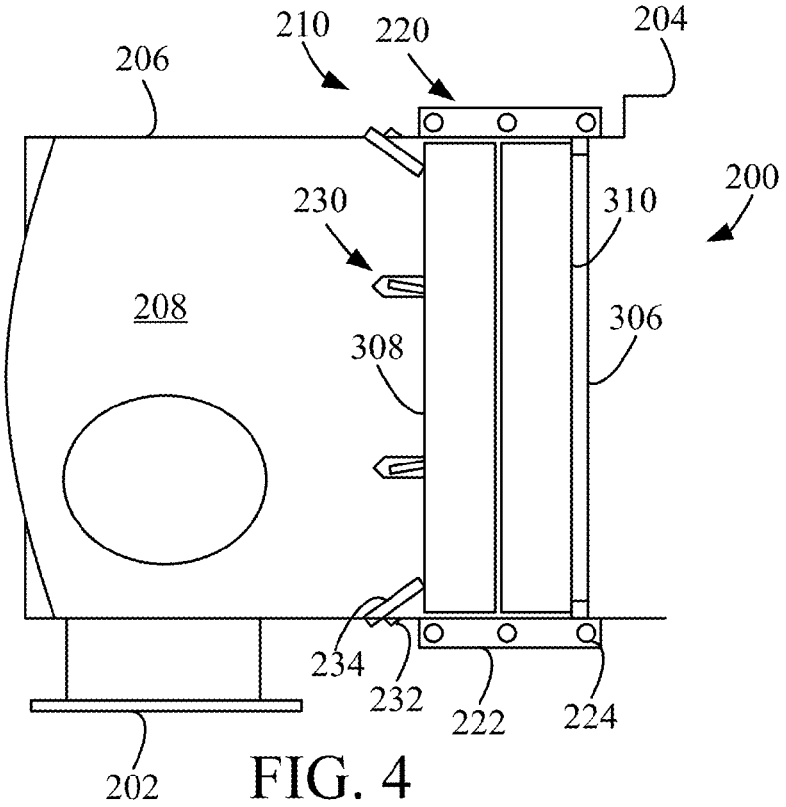
FIG. 4 is a partial cross-sectional view of the diesel oxidation catalyst component of FIG. 2 in a second configuration showing a first diesel oxidation catalyst and a second diesel oxidation catalyst secured between bolts of an angled jacking bolt assembly and an inner ring of the catalyst chamber body of the diesel oxidation catalyst component.

FIG. 4 depicts a partial cross-sectional view of the DOC component 200 of FIG. 2 showing a first diesel oxidation catalyst 308 and a second diesel oxidation catalyst 310 secured between bolts 234 of the angled jacking bolt assembly 230 and an inner ring 306 of the catalyst chamber body 206 of the DOC component 200. FIG. 4 depicts a second configuration for the diesel oxidation catalyst assembly 210 having dual diesel oxidation catalysts 308, 310. Each bolt 234 is guided by and attached to the angled threaded mounts 232 such that an end of each bolt 234 contacts and engages with the first diesel oxidation catalyst 308 to provide a lateral compression force against the first diesel oxidation catalyst 308 when each bolt 234 is threaded into the angled threaded mounts 232. The first diesel oxidation catalyst 308 abuts a second diesel oxidation catalyst 310 such that the compression force applied to the first diesel oxidation catalyst 308 is transferred and applied to the second diesel oxidation catalyst 310. In some implementations, a gasket or other intermediary component may be interposed between the first diesel oxidation catalyst 308 and the second diesel oxidation catalyst 310. The second diesel oxidation catalyst 310 is compressed against an inner ring 306 of the catalyst chamber body 206 of the DOC component 200 such that the bolts 234 and the inner ring 306 of the catalyst chamber body 206 cooperate to secure the first diesel oxidation catalyst 308 and the second diesel oxidation catalyst 310 within the catalyst chamber 208. In some implementations, a sealing gasket may be interposed between the second diesel oxidation catalyst 310 and the inner ring 306 of the catalyst chamber body 206 of the DOC component 200.

Once the bolts 234 are tightened to a specified torque, the first diesel oxidation catalyst 308 and the second diesel oxidation catalyst 310 are no longer free to move about within the catalyst chamber 208 of the DOC component 200.

Figure 5:
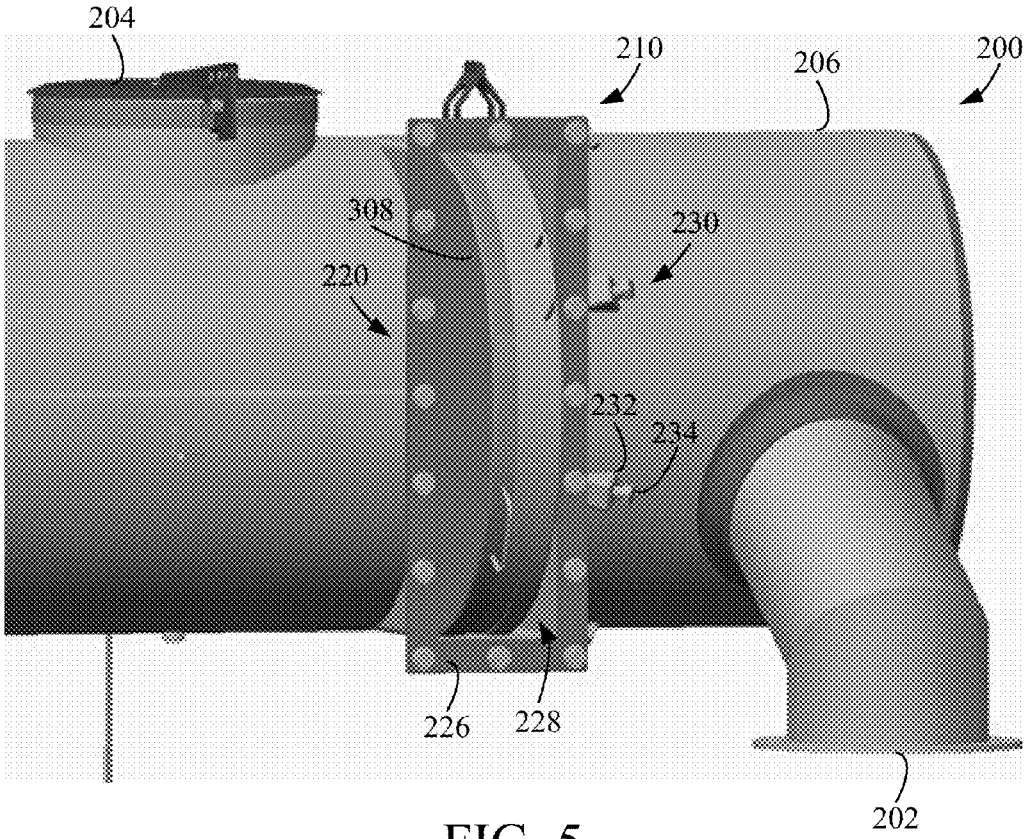
FIG. 5 is a perspective view of the diesel oxidation catalyst component of FIG. 2 with an access panel removed and showing a diesel oxidation catalyst t being removed through an opening.

FIG. 5 depicts the DOC component 200 of FIG. 2 with the access panel removed and showing a diesel oxidation catalyst 308 being removed through an opening 228. As noted above, the access panel assembly 220 includes an access panel and a plurality of securing bolts for coupling the access panel to a mount 226 of the catalyst chamber body 206. In some implementations, a gasket may be interposed between a bottom surface of the access panel and the mount 226 of the catalyst chamber body 206 to assist in fluidly sealing the access panel and the mount 226 when the bolts are secured to the mount 226. The mount 226 may include threaded holes for securing the bolts to the mount 226 or the mount 226 may have through holes such that the bolts may be secured to nuts or other fasteners on an opposite side of the mount 226. The mount 226 of the catalyst chamber body 206 defines an opening 228 through which access is provided to the diesel oxidation catalyst(s) and/or spacing component within the catalyst chamber 208 of the DOC component 200. Thus, the diesel oxidation catalysts and/or spacing components within the catalyst chamber 208 of the DOC component 200 may be removed, replaced, serviced, etc. without removing the DOC component 200 from an exhaust system.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

The terms "fluidly coupled," "in fluid communication," and the like as used herein mean the two components or objects have a pathway formed between the two components or objects in which a fluid, such as water, air, gaseous reductant, gaseous ammonia, etc., may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary

What is claimed is:

1. A diesel oxidation catalyst component comprising:
an inlet;
an outlet; and
a catalyst chamber body in fluid communication with the inlet and the outlet, the catalyst chamber comprising:
an angled jacking bolt assembly configured to secure a diesel oxidation catalyst within a catalyst chamber defined by the catalyst chamber body, the angled jacking bolt assembly comprising an angled threaded mount and a bolt, the angled threaded mount positioned at a non-perpendicular angle relative to the diesel oxidation catalyst and the catalyst chamber body, the bolt applying a lateral compression force to secure the diesel oxidation catalyst within the catalyst chamber without utilizing jam nuts.

2. The diesel oxidation catalyst component of claim 1, wherein the angled jacking bolt assembly comprises a plurality of angled threaded mounts and a plurality of jacking bolts, each of the plurality of jacking bolts configured to thread through a respective angled threaded mount of the plurality of angled threaded mounts so to secure the diesel oxidation catalyst within the catalyst chamber.

3. The diesel oxidation catalyst component of claim 1, wherein the catalyst chamber body comprises an inner ring, and wherein the angled jacking bolt assembly is configured to apply the lateral compression force to the diesel oxidation catalyst against the inner ring.

4. The diesel oxidation catalyst component of claim 3, wherein the bolt of the angled jacking bolt assembly engages a spacer to apply the lateral compression force to the diesel oxidation catalyst.

5. The diesel oxidation catalyst component of claim 3, wherein the diesel oxidation catalyst is a second diesel oxidation catalyst, and wherein the bolt of the angled jacking bolt assembly engages a first diesel oxidation catalyst so to apply the lateral compression force to the second diesel oxidation catalyst.

6. The diesel oxidation catalyst component of claim 3, wherein a sealing gasket is interposed between the diesel oxidation catalyst and the inner ring.

7. The diesel oxidation catalyst component of claim 1, wherein the catalyst chamber body further comprises an access panel assembly.

8. The diesel oxidation catalyst component of claim 7, wherein the access panel assembly comprises an access panel and a plurality of securing bolts, the access panel assembly fluidly sealing an opening defined by a mount of the catalyst chamber body when the access panel is secured to the mount by the plurality of securing bolts.

9. The diesel oxidation catalyst component of claim 8, wherein the opening is sized to permit removal of the diesel oxidation catalyst from within the catalyst chamber of the catalyst chamber body.

10. The diesel oxidation catalyst component of claim 9, wherein the diesel oxidation catalyst is removable from within the catalyst chamber of the catalyst chamber body without removing the diesel oxidation catalyst component from an exhaust system.

11. A system comprising:

an internal combustion engine; and a diesel oxidation catalyst component comprising:

an outlet;

a first inlet in fluid communication with a first exhaust manifold of the internal combustion engine;

a second inlet in fluid communication with a second exhaust manifold of the internal combustion engine;

a catalyst chamber body in fluid communication with the first inlet and the second inlet, the catalyst chamber body comprising:

a first diesel oxidation catalyst assembly in a first exhaust flow path from the first inlet to the outlet, the first diesel oxidation catalyst assembly comprising a first angled jacking bolt assembly configured to secure a first diesel oxidation catalyst within a catalyst chamber defined by the catalyst chamber body, the first angled jacking bolt assembly comprising a first angled threaded mount and a first bolt, the first angled threaded mount positioned at a first non-perpendicular angle relative to the first diesel oxidation catalyst and the catalyst chamber body, the bolt applying a first lateral compression force to secure the first diesel oxidation catalyst within the catalyst chamber without utilizing jam nuts; and a second diesel oxidation catalyst assembly in a second exhaust flow path from the second inlet to the outlet, the second diesel oxidation catalyst assembly comprising a second angled jacking bolt assembly configured to secure a second diesel oxidation catalyst within the catalyst chamber defined by the catalyst chamber body, the second angled jacking bolt assembly comprising a second angled threaded mount and a second bolt, the second angled threaded mount positioned at a second non-perpendicular angle relative to the second diesel oxidation catalyst and the catalyst chamber body, the second bolt applying a second lateral compression force to secure the second diesel oxidation catalyst within the catalyst chamber without utilizing jam nuts.

12. The system of claim 11, wherein the first angled jacking bolt assembly comprises a plurality of angled threaded mounts and a plurality of jacking bolts, each of the plurality of jacking bolts configured to thread through a respective angled threaded mount of the plurality of angled threaded mounts so as to secure the first diesel oxidation catalyst within the catalyst chamber.

13. The system of claim 11, wherein the catalyst chamber body further comprises an inner ring, the first angled jacking bolt assembly configured to apply the first lateral compression force to the first diesel oxidation catalyst against the inner ring.

14. The system of claim 13, wherein the first bolt of the first angled jacking bolt assembly engages a spacer to apply the first lateral compression force to the first diesel oxidation catalyst.

15. The system of claim 13, wherein the first bolt of the first angled jacking bolt assembly engages a third diesel oxidation catalyst to apply the first lateral compression force to the first diesel oxidation catalyst.

16. The system of claim 13, wherein a sealing gasket is interposed between the first diesel oxidation catalyst and the inner ring.

17. The system of claim 11, wherein the catalyst chamber body further comprises an access panel assembly comprising an access panel and a plurality of securing bolts, the access panel assembly fluidly sealing an opening defined by a mount of the catalyst chamber body when the access panel is secured to the mount by the plurality of securing bolts.

18. A catalyst chamber body comprising:

an angled jacking bolt assembly comprising a plurality of angled threaded mounts and a plurality of jacking bolts, each of the plurality of jacking bolts configured to thread through a respective angled threaded mount of the plurality of angled threaded mounts so as to secure a diesel oxidation catalyst within a catalyst chamber, each respective angled threaded mount positioned at a non-perpendicular angle relative to the diesel oxidation catalyst and the catalyst chamber, each of the plurality of jacking bolts applying a lateral compression force to secure the diesel oxidation catalyst within the catalyst chamber without utilizing jam nuts; and an access panel assembly comprising an access panel and a plurality of securing bolts, the access panel assembly fluidly sealing an opening defined by a mount of the catalyst chamber body when the access panel is secured to the mount by the plurality of securing bolts.

19. The catalyst chamber body of claim 18 further comprising:

an inner ring;

each of the plurality of jacking bolts configured to apply the lateral compression force to the diesel oxidation catalyst against the inner ring when threaded through a respective angled threaded mount.

20. The catalyst chamber body of claim 18, wherein the opening is sized to permit removal of the diesel oxidation catalyst from within the catalyst chamber.

* * * * *